United States Patent [19]

Riehl

[11] 3,938,945

[45] Feb. 17, 1976

[54] BURNER CONSTRUCTION AND METHOD OF MAKING THE SAME

[75] Inventor: Fred Riehl, Greensburg, Pa.

[73] Assignee: Robertshaw Controls Company, Richmond, Va.

[22] Filed: Oct. 16, 1974

[21] Appl. No.: 515,231

[52] U.S. Cl. ..... 431/191; 431/286

[51] Int. Cl.[2] ..... F23D 13/02

[58] Field of Search ..... 431/191, 286

[56] References Cited

UNITED STATES PATENTS

| | | | |
|---|---|---|---|
| 2,993,534 | 7/1961 | Greiher et al. | 431/191 X |
| 3,092,169 | 6/1963 | Lohman | 431/191 |
| 3,391,982 | 7/1968 | Ward | 431/286 |
| 3,578,891 | 5/1971 | Cavestany et al. | 431/191 |

*Primary Examiner*—Edward G. Favors

*Attorney, Agent, or Firm*—Candor, Candor & Tassone

[57] ABSTRACT

A burner construction having a tubular member provided with an inlet for receiving fuel from the supply thereof and having an outlet for issuing and burning a main flow of the received fuel to produce a main flame at the outlet. A deflector plate is carried by the tubular member adjacent the outlet for directing some of the received fuel substantially transverse of the tubular member to create an ignition flame substantially transverse to the tubular member for igniting the main flow of fuel at the outlet to create the main flame. Thus, a series of such burner constructions can be disposed in a side-by-side relation and one pilot burner can be utilized to ignite the same in serial relation through the ignitor flame plates thereof.

12 Claims, 6 Drawing Figures

BURNER CONSTRUCTION AND METHOD OF MAKING THE SAME

This invention relates to an improved burner construction and to a method of making the same as well as to an improved fuel control system utilizing such a burner construction and method of making such a fuel control system.

It is well known that fuel burning apparatus utilize a plurality of tubular burners disposed in particular arrangements thereof and that some means must be provided for igniting the fuel issuing from such tubular burners when it is desired to utilize the same.

Accordingly, it is a feature of this invention to provide a burner construction which permits a single pilot burner to ignite a plurality of such burners in a particular arrangement thereof.

In particular, one embodiment of this invention provides a burner construction having a tubular member provided with an inlet for receiving fuel from a supply thereof and an outlet for issuing and burning a main flow of the received fuel to produce a main flame at the outlet. A deflector means is carried by the tubular member adjacent the outlet thereof for directing some of the received fuel substantially transverse of the tubular member to create ignitor flame means substantially transverse to the tubular member for igniting the main flow of fuel at the outlet to create the main flame means when the ignitor flow of fuel is ignited.

Such burner constructions can be arranged in side-by-side relation with the inlets thereof respectively interconnected to a source of fuel. A single pilot burner means can be arranged adjacent one of the deflector means of one of the tubular members so that the same is adapted to ignite the ignitor flow of fuel issuing therefrom and such ignited burner means, through the deflector means thereof, will ignite the next adjacent ignitor flow of fuel to thereby ignite the main flow of fuel of that adjacent burner construction, whereby the tubular burners are adapted to be ignited in a serial manner by the single pilot burner means.

Accordingly, it is an object of this invention to provide an improved burner construction having one or more of the novel features set forth above or hereinafter shown or described.

Another object of this invention is to provide a method of making such a burner construction or the like.

Another object of this invention is to provide an improved fuel control system utilizing such a burner construction or the like.

Another object of this invention is to provide an improved method of making such a fuel control system or the like.

Other objects, uses and advantages of this invention are apparent from a reading of this description, which proceeds with reference to the accompanying drawings forming a part thereof and wherein.

Figure 1:
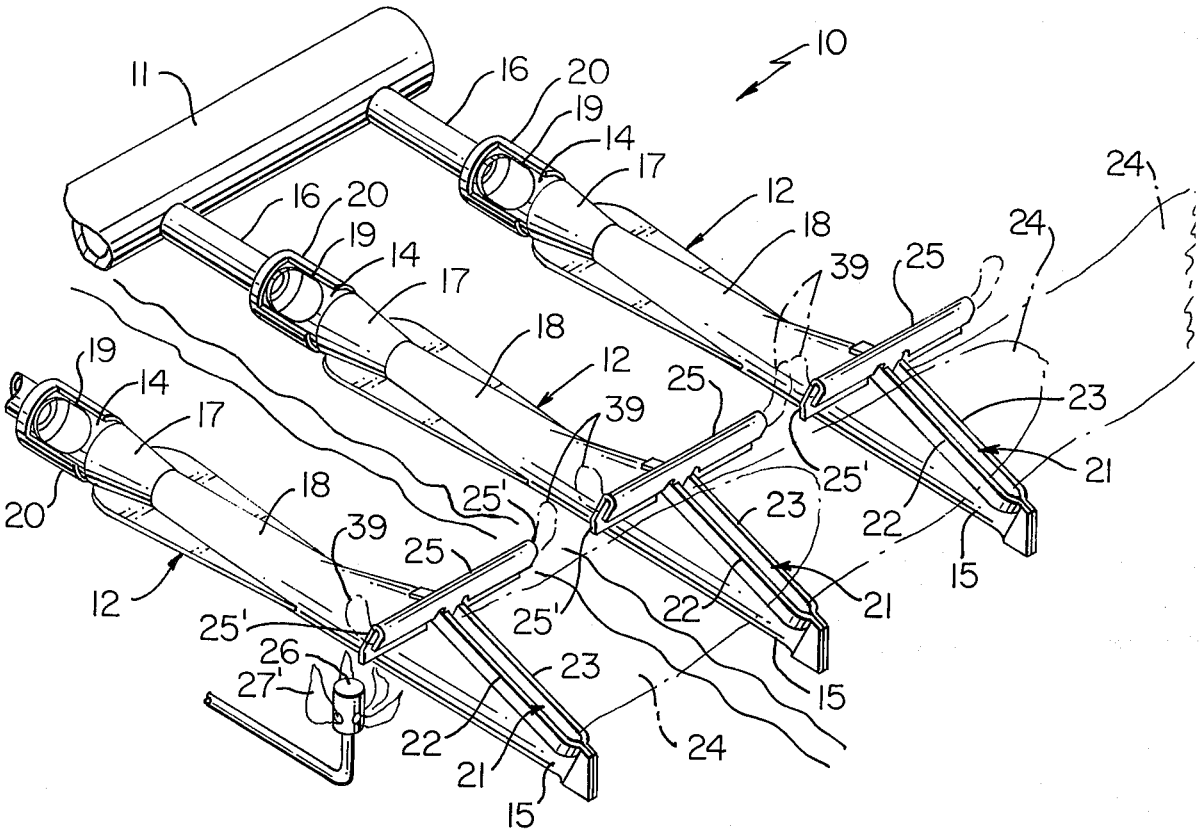
FIG. 1 is a perspective view, partially broken away and illustrating the fuel control system of this invention utilizing the burner constructions of this invention.
Figure 2:
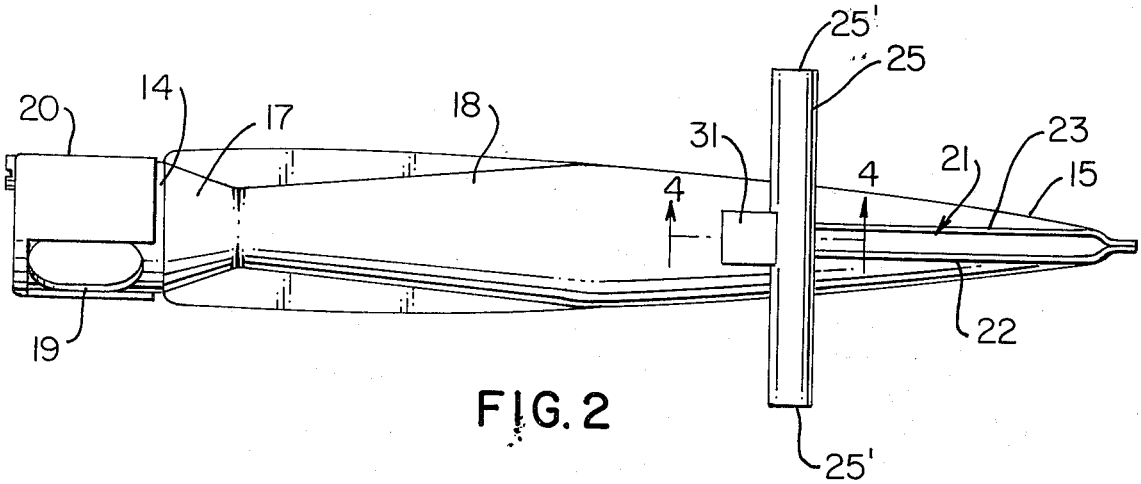
FIG. 2 is an enlarged top view of one of the burner constructions of FIG. 1.
Figure 3:
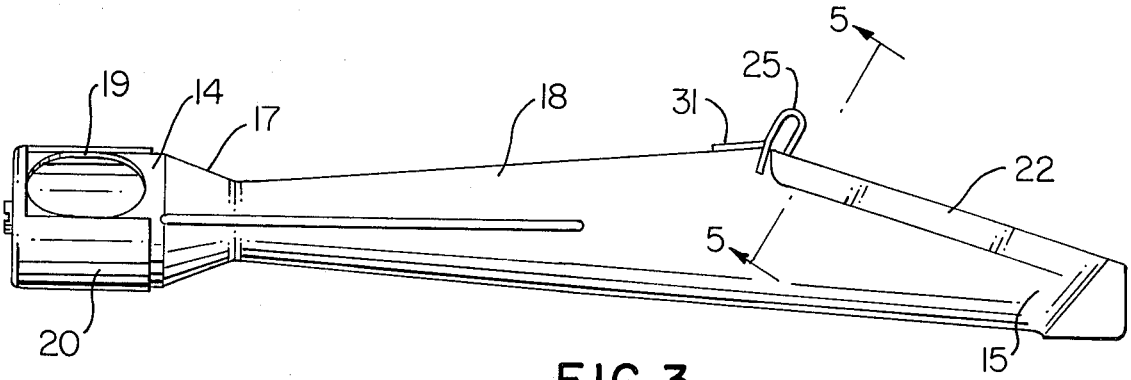
FIG. 3 is a side view of the burner construction of FIG. 2.
Figure 4:
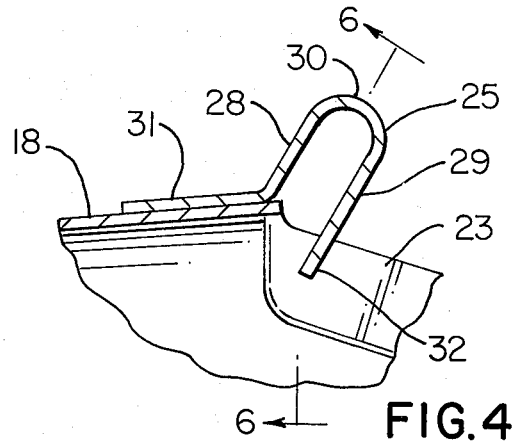
FIG. 4 is an enlarged, fragmentary, cross-sectional view taken on line 4—4 of FIG. 2.

While the various features of this invention are hereinafter illustrated and described as being particularly adapted to provide a fuel control system utilizing a plurality of burner constructions of this invention, it is to be understood that the various features of this invention can be utilized singly or in any combination thereof to provide a single burner construction for other systems as desired.

Therefore, this invention is not to be limited to only the embodiments illustrated in the drawings, because the drawings are merely utilized to illustrate one of the wide variety of uses of this invention.

Referring now to FIG. 1, the improved fuel control system of this invention is generally indicated by the reference numeral 10 and comprises a fuel supply manifold 11 interconnected to a plurality of like burner constructions of this invention that are generally indicated by the reference numeral 12, the fuel control system 10 being utilized for heat-producing purposes in any desired apparatus, such as a cooking apparatus or the like.

The burner constructions 12 each has a tubular member 18 provided with an inlet end 14 and an outlet end 15, the inlet end 14 being coupled to the manifold 11 by a branch conduit 16 and cooperating with a venturi portion 17 thereof to draw primary air into the inlet end 14 of the tubular member 18 at air inlet openings 19 adapted to have the effective area thereof adjusted by an adjusting cap 20 in a manner well known in the art.

The mixed fuel and air in the respective tubular member 18 is adapted to issue out of an elongated slot-like opening 21 formed at the outlet end 15 thereof and respectively being defined between a pair of substantially parallel side walls 22 and 23 formed in the top portion of the outlet end 15 thereof so that subsequently the issuing fuel can burn as a main flame means 24 for any desired heating purpose.

The tubular member 18 can be formed of a single metallic piece or a plurality of metallic pieces as desired and may be formed into the configuration illustrated in the drawings by suitable stamping operations and the like.

The burner constructions 12 of the fuel control system 10 of FIG. 1 have the tubular members 18 thereof disposed in parallel, spaced apart side-by-side relation in the manner illustrated in FIG. 1 and each is provided with a deflector means 25 in a manner hereinafter described to permit all of the burner constructions 12 to be ignited in a serial manner by a single pilot burner means 26 that is interconnected to the fuel supply and normally has a continuously burning pilot flame means 27 for a purpose hereinafter described.

Figure 5:
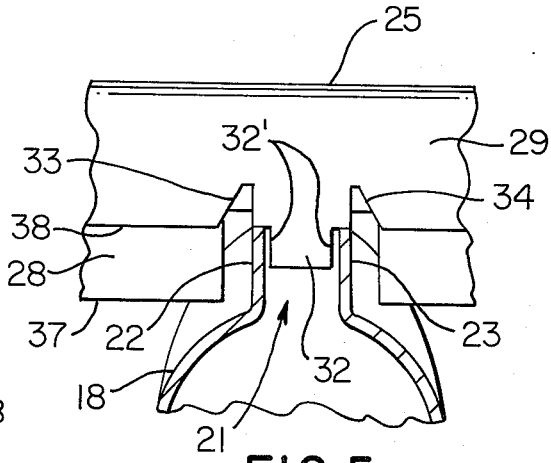
FIG. 5 is an enlarged, fragmentary, cross-sectional view taken on line 5—5 of FIG. 3.

The deflector means 25 for each burner construction 12 comprises a metallic plate-like member formed into substantially a U-shape defined by a pair of opposed legs 28 and 29 and interconnected together by a bight portion or cross member 30, each U-shaped member 25 being mounted to its respective tubular member 18 in substantially an inverted manner by a rearwardly extending tang 31 that is formed integrally with the leg 28 thereof and is disposed on top of the burner construction of the tubular member 18 to be fastened thereto by welding or the like. The front leg 29 of each deflector plate 25 has a depending deflector tab 32 integral with the leg 29 thereof and projecting into the outlet opening 21 of the respective tubular member 18, the deflector tab 32 being so constructed and arranged that the same has its side edges 32' inwardly spaced from the side walls 22 and 23 a slight amount as illustrated in FIG. 5 for a purpose hereinafter described. Also, each deflector means 25 has a pair of inverted substantially V-shaped notches 33 and 34 formed in the front leg 29 thereof adjacent the deflector tab 32 and outboard of the side walls 22 and 23 of its respective tubular member 18 as illustrated in FIG. 5.

Figure 6:
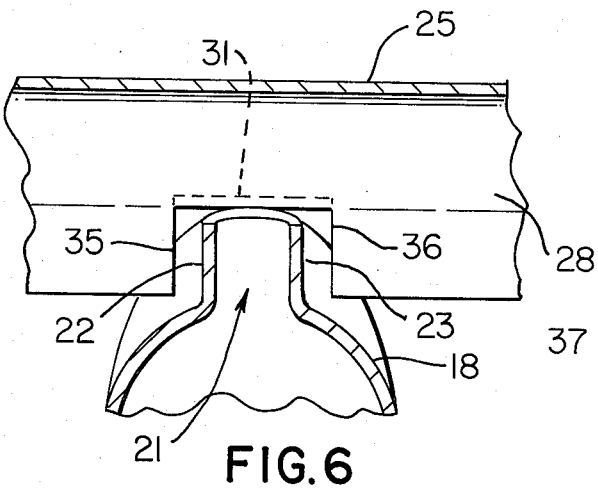
FIG. 6 is an enlarged, fragmentary, cross-sectional view taken on line 6—6 of FIG. 4.

The securing tab 31 of each deflector means 25 is partially carved from the rear leg 28 thereof in the manner illustrated in FIG. 6 to define a pair of slots 35 and 36 on each side of the side walls 22 and 23 of its respective tubular member 18 and outboard of the same, the rear leg 29 of each deflector plate 25 having a lower edge 37 which extends below the lower main edge 38 of the front leg 29 as illustrated.

Thus, it can be seen that each burner construction 12 of this invention can be formed in a relatively simple manner to include the deflector means 25 therefor which comprises a one-piece structure readily secured to the tubular member 18 as previously described to operate in a manner now to be described.

Assuming that the fuel supply manifold 11 has suitable control means (not shown) for shutting off the flow of fuel through the manifold 11 to all of the burner constructions 12 when it is not desired to utilize the fuel system 10 whereby no fuel can issue from the outlets 21 of the burner constructions 12. However, the pilot burner means 26 has a flow of fuel supplied thereto in a continuous manner so that the flame means 27 continuously appears at the pilot burner means 26.

Thus, when the operator desires to turn on the burner constructions 12, the operator operates a suitable control device (not shown) that causes the manifold 11 to substantially simultaneously supply fuel through the branch conduits 16 into the inlet ends 14 of the tubular members 18 whereby such flow of fuel into the tubular members 18 draws primary air therein through the openings 19 by the venturi effect caused by the venturi portions 17 in a manner well known in the art. Such mixed air and fuel passes to the outlets 21 of the burner constructions 12 to issue therefrom. However, a small amount of such main flow of fuel to the outlet 21 of each burner construction 12 impinges against the inside surface of the deflector tab 32 thereof and spreads out through the U-shaped deflector means 25 to the opposed ends 25' thereof to issue therefrom.

The burner construction 12 that is immediately adjacent the pilot burner means 26 now has the ignition fuel issuing from the left-hand end 25' thereof as illustrated in FIG. 1 immediately ignited by the pilot flame 27 whereby the ignited fuel at the left-hand 25' of the deflector means 25 of the burner construction 12 adjacent the pilot burner means 26 causes ignition of the fuel completely through the U-shaped deflector means 25 to the right-hand end thereof. The ignitor flames 39 of that initially ignited burner construction 12 also ignite the fuel now issuing from the main outlet 21 thereof to create the main flame 24 as illustrated in FIG. 1.

The ignitor flame 29 now at the right-hand end 25' of the first burner construction 12, in a serial manner, lights the ignitor fuel issuing from the left-hand end 25' of the deflector plate 25 of the next adjacent burner construction 12 which likewise forms its ignitor flame means 39 to not only ignite its main flow of fuel to create its main flame 24, but also ignites the next adjacent ignitor fuel from the deflector 25 of the next adjacent burner construction 12.

In this manner, it can be seen that a plurality of side-by-side burner constructions 12 can be readily ignited by the single pilot burner means 26 in a serial manner as previously described as long as the pilot burner means 26 can ignite the ignition flow of fuel from one of the side-by-side burner constructions 12 in the manner previously described.

It is believed that in order to insure that each ignitor flame means 39 of each burner construction 12 will ignite the main flow of fuel of its respective tubular member 18 at its outlet opening 21, the spacing provided between the sides 32' of the deflector tab 32 and the side walls 22 and 23 of the deflector tubular member 18 as well as the arrangement of the V-shaped notches 33 and 34 permits sufficient ignitor flame means 39 to be present at the opening 21 of the respective tubular member 18 to ignite the main flow of fuel therefrom.

Therefore, it can be seen that this invention not only provides an improved burner construction and method of making the same, but also this invention provides an improved fuel control system utilizing a plurality of such burner constructions and a single pilot burner means therefor and an improved method of making such a fuel control system or the like.

While the forms and methods of this invention now preferred have been illustrated and described as required by the Patent Statute, it is to be understood that other forms and method steps can be utilized and still come within the scope of the appended claims.

What is claimed is:

1. A burner construction comprising a tubular member having an inlet for receiving fuel from a supply thereof and having an outlet for issuing and burning a main flow of said received fuel to produce a main flame means at said outlet, said outlet being elongated and having opposed ends, and a deflector means carried by said tubular member adjacent one end of said outlet for directing some of said received fuel substantially transverse of said tubular member to create ignitor flame means substantially transverse to said tubular member for igniting said main flow of fuel at said outlet to create said main flame means, said deflector means being adapted to deflect said received fuel to each side of said tubular member to create said ignitor flame means at both sides of said tubular member, said deflector means comprising a substantially U-shaped member disposed in substantially an inverted position on top of and substantially transverse of said tubular member whereby said inverted U-shaped member has a pair of depending spaced apart legs joined together at the tops thereof by an arcuate section and said deflected fuel flow is adapted to issue from opposed ends of said U-shaped member, said U-shaped member having a tab that extends from the bottom of one of said legs and projects into said outlet of said tubular member to defect said main fuel flow into said U-shaped member.

2. A burner construction as set forth in claim 1 wherein said tubular member has side walls defining said outlet therebetween, said tab of said U-shaped member being spaced from said side walls.

3. A burner construction as set forth in claim 2 wherein said U-shaped member has a pair of notches provided in said one leg thereof adjacent and on opposite sides of said tab and outboard of said outlet of said tubular member.

4. A method of making a burner construction comprising the steps of forming a tubular member with an inlet for receiving fuel from a supply thereof and with an outlet for issuing and burning a main flow of said received fuel to produce a main flame means at said outlet, said outlet being elongated and having opposed ends, securing a deflector means to said tubular member adjacent one end of said outlet for directing some of said received fuel substantially transverse of said tubular member to create ignitor flame means substantially transverse to said tubular member for igniting said main flow of fuel at said outlet to create said main flame means, forming said deflector means so as to be adapted to deflect said received fuel to each side of said tubular member to create said ignitor flame means at both sides of said tubular member, forming said deflector means as a substantially U-shaped member disposed in substantially an inverted position on top of and substantially transverse of said tubular member whereby said inverted U-shaped member has a pair of depending spaced apart legs joined together at the tops thereof by an arcuate section and said deflected fuel flow is adapted to issue from opposed ends of said U-shaped member, and forming said U-shaped member with a tab that extends from the bottom of one of said legs and projects into said outlet of said tubular member to deflect said main fuel flow into said U-shaped member.

5. A method of making a burner construction as set forth in claim 4 wherein said tubular member has side walls defining said outlet therebetween and including the step of forming said tab of said U-shaped member so as to be spaced from said side walls.

6. A method of making a burner construction as set forth in claim 5 and including the step of forming said U-shaped member with a pair of notches in said one leg thereof adjacent and on opposite sides of said tab and outboard of said outlet of said tubular member.

7. A fuel control system comprising a source of fuel and a plurality of burner constructions disposed in side-by-side relation, each burner construction comprising a tubular member having an inlet for receiving fuel from said source thereof and having an outlet for issuing and burning a main flow of said received fuel to produce a main flame means at said outlet, each outlet being elongated and having opposed ends, a deflector means carried by each said tubular member adjacent one end of said outlet for directing some of said received fuel substantially transverse of said tubular member to create ignitor flame means substantially transverse to said tubular member for igniting said main flow of fuel at said outlet to create said main flame means, and pilot burner means adjacent one of said deflector means of one of said tubular members to ignite said deflected fuel to create said ignitor flame means which is adapted to cause serial ignition of said deflected fuel at each said deflector means and thus serial creation of said main flame means at each said tubular member, each said deflector means being adapted to deflect said received fuel to each side of its respective tubular member to create said ignitor flame means at both sides of said respective tubular member, each said deflector means comprising a substantially U-shaped member disposed in substantially an inverted position on top of and substantially transverse of its respective tubular member whereby each said inverted U-shaped member has a pair of depending spaced apart legs joined together at the tops thereof by an arcuate section and said deflected fuel flow is adapted to issue from opposed ends of each said U-shaped member, each said U-shaped member having a tab that extends from the bottom of one of said legs thereof and projects into said outlet of its respective tubular member to deflect said main fuel flow into said U-shaped member.

8. A fuel control system as set forth in claim 7 wherein each said tubular member has side walls defining said outlet therebetween, said tab of each said U-shaped member being spaced from said side walls of its respective tubular member.

9. A fuel control system as set forth in claim 8 wherein each said U-shaped member has a pair of notches provided in said one leg thereof adjacent and on opposite sides of said tab and outboard of said outlet of its respective tubular member.

10. A method of making a fuel control system comprising the steps of providing a source of fuel, disposing a plurality of burner constructions in side-by-side relation, forming each burner construction from a tubular member having an inlet for receiving fuel from said source thereof and having an outlet for issuing and burning a main flow of said received fuel to produce a main flame means at said outlet, each said outlet being elongated and having opposed ends, securing a deflector means to each said tubular member adjacent one end of said outlet thereof for directing some of said received fuel substantially transverse of said tubular member to create ignitor flame means substantially transverse to said tubular member for igniting said main flow of fuel at said outlet to create said main flame means, disposing pilot burner means adjacent one of said deflector means of one of said tubular members to ignite said deflected fuel to create said ignitor flame means which is adapted to cause serial ignition of said deflected fuel at each said deflector means and thus serial creation of said main flame means at each said tubular member, forming each said deflector means so as to be adapted to deflect said received fuel to each side of its respective tubular member to create said ignitor flame means at both sides of said respective tubular member, forming each said deflector means as a substantially U-shaped member disposed in substantially an inverted position on top of and substantially transverse of its respective tubular member whereby each said inverted U-shaped member has a pair of depending spaced apart legs joined together at the tops thereof by an arcuate section and said deflected fuel flow is adpated to issue from opposed ends of said U-shaped member, and forming each said U-shaped member with a tab that extends from the bottom of one of said legs thereof and projects into said outlet of its respective tubular member to deflect said main fuel flow into said U-shaped member.

11. A method as set forth in claim 10 wherein each said tubular member has side walls defining said outlet therebetween and including the step of forming each said tab of said U-shaped member so as to be spaced from said side walls of its respective tubular member.

12. A method as set forth in claim 11 and including the step of forming each said U-shaped member with a pair of notches provided in said one leg thereof adjacent and on opposite sides of said tab and outboard of said outlet of its respective tubular member.

* * * * *